United States Patent [19]

Krupp et al.

[11] Patent Number: 5,076,795

[45] Date of Patent: Dec. 31, 1991

[54] ELECTRICAL TERMINAL BLOCK ASSEMBLY

[75] Inventors: Eric Krupp, Canton; Dave Tinder, Dearborn, both of Mich.

[73] Assignee: United Technologies Automotive, Inc., Dearborn, Mich.

[21] Appl. No.: 633,698

[22] Filed: Dec. 24, 1990

[51] Int. Cl.[5] ..... H01R 9/09

[52] U.S. Cl. ..... 439/79; 439/80; 439/83; 439/876

[58] Field of Search ..... 439/79-83, 439/876, 873, 676

[56] References Cited

U.S. PATENT DOCUMENTS 4,292,736 10/1981 Hughes et al. ..... 439/79

4,907,978 3/1990 Bowen ..... 439/79

FOREIGN PATENT DOCUMENTS 2278220 2/1976 France ..... 439/79

*Primary Examiner*—Paula A. Bradley

*Attorney, Agent, or Firm*—Edward L. Kochey, Jr.

[57] ABSTRACT

A support block has slots in the top and rear faces receiving bent terminal strips. Protrusions on the strips abut a forward or downwardly facing surface at the front of the top slot. Protrusions at the other end of the strips abut a downwardly facing surface at the bottom of the rear slot. A terminal tip extends forwardly, and a tang for soldering into a circuit board extends downwardly. Terminal strips without protrusions fit within slots in the bottom face of the support block.

9 Claims, 1 Drawing Sheet

ELECTRICAL TERMINAL BLOCK ASSEMBLY

TECHNICAL FIELD

The invention relates to terminals stamped from flat metal and in particular to terminals extending outwardly adjacent to a printed circuit board.

BACKGROUND OF THE INVENTION

Connections for terminals to a printed circuit board are often arranged in two parallel rows, one row close to the board and the other row above the first further from the circuit board. Tight tolerances are applied to the location of the terminals and three mutually perpendicular planes with respect to the circuit board and to the molded connector shell which surrounds the terminals. The angular orientation of the terminals must also be closely controlled so that the proper fit with the mating connector can be assured. The terminals must also be supported so as to adequately resist the push and pull forces associated with connecting and disconnecting the mating connector. The location and orientation of the terminal must be maintained after assembly to the circuit board, down the assembly conveyor, through wave soldering and through assembly into the module housing.

Current methods of supporting such terminals involve pushing the terminals individually or in groups, into closely fitting slots in a plastic wall. Since both the slots and the terminals are subject to dimensional variations, control of location and orientation is limited. Barbs on the terminals which engage the sides of the slots are sometimes used to resist pushout.

SUMMARY OF THE INVENTION

A substantially rectangular support block has a plurality of parallel slots across the top and rear faces. A plurality of terminal strips with a tang at one end and a terminal tip at the other end are bent to substantially 90° to fit within the slots on the top and rear faces. Protrusions on the front end of each terminal strip abut a forward or downward facing surface at the front edge of the top slot. Protrusions near the bottom of the terminal strip, but above the tang, abut downwardly facing surface adjacent the lower edge of the slot in the rear face, with a tang extending downwardly for soldering into a circuit board.

There may also be a bottom row of terminals free of protrusions which fit within slots on the bottom face of the circuit board. These slots pass from the front surface partially to the rear face, and preferably, are of a dovetail shape to retain the terminal strip therein which in this case is free of protrusions. The tang end of the strip is bent downwardly 90° extending below the block for soldering into a circuit board.

DESCRIPTION OF THE PREFERRED EMBODIMENT

Figure 1:
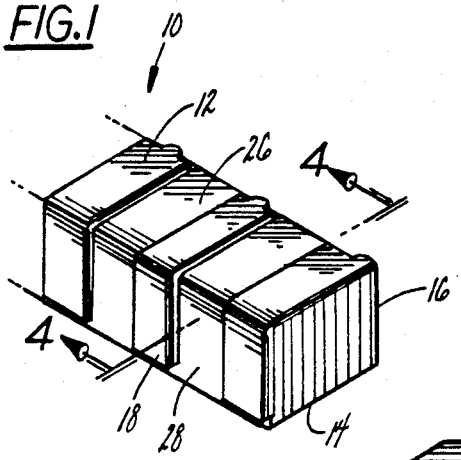
FIG. 1 is an isometric view of a support block.
Figure 2:
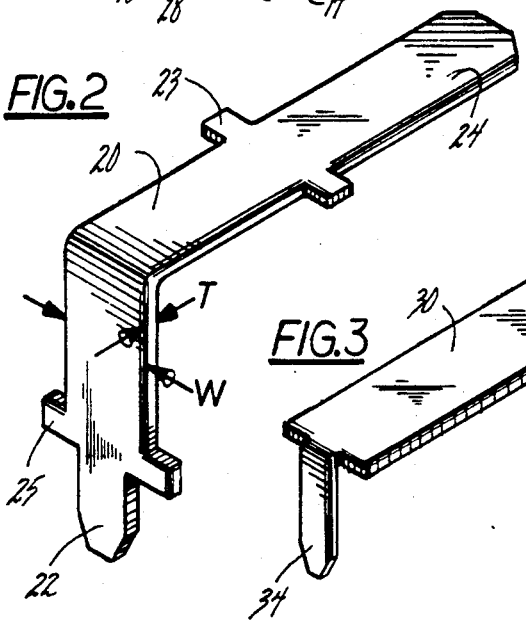
FIG. 2 is an isometric view of the terminal used for the upper row of terminals.
Figure 3:
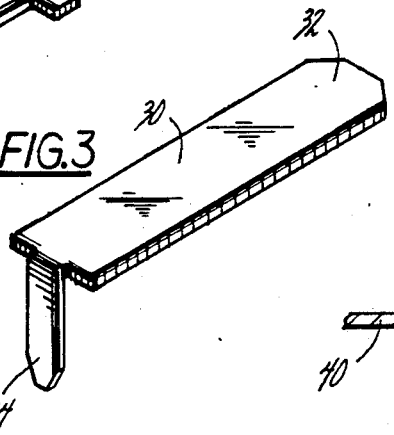
FIG. 3 is a view of the lower terminal.

Referring to FIG. 1, a nonconductive elongated support block 10 is substantially rectangular in cross section. It has a top face 12, a bottom face 14, front face 16 and a rear face 18. A plurality of conductive terminal strips 20 illustrated in FIG. 2 have a width W of 2.8 mm and a thickness T of 0.8 mm. Each strip has a tang 22 at one end for soldering into a circuit board and a terminal tip 24 at the other end for mating with the connector. The block 16 has a plurality of top slots 26 across the top face 12 and a plurality of rear slots 28 across the rear face 18. These slots are each of a width equal to the width of terminal slot 20.

The terminal strip 20 is bent at an angle substantially equal to the angle between slots 26 and 28, this being 90° as illustrated. The bend in the terminal strip 20 while substantially 90° should be not be greater than 90°, but preferably is slightly less than 90° which provides slight spring action to hold the strip in place.

Where a lower row of terminals is desired, lower terminal strip 30 is supplied, the strip also having a terminal top 32 for mating with the connector and a tang 34 for soldering into a printed circuit board. This tang 34 is bent at 90° from the remainder of the lower terminal strip.

Figure 4:
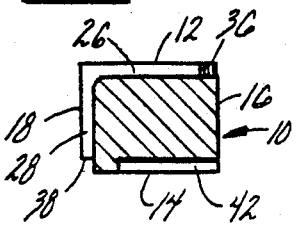
FIG. 4 is a section through the terminal block.

FIG. 4 is a section through the terminal block and it can be seen that adjacent to the front edge of top slot 26 is a forward facing surface 36. Also adjacent to the lower edge of rear slot 28 is a downwardly facing surface 38.

Figure 5:
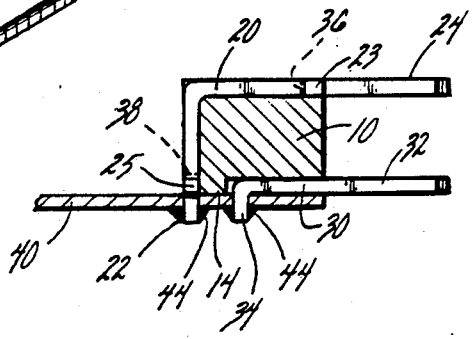
FIG. 5 is a section through the terminal block showing the terminals in place.

FIG. 5 illustrates the terminal block and the terminals mounted on the printed circuit board 40.

Front protrusions 23 are located on each of the strips extending beyond the width of the strip at a location such that when the strip is installed they will be adjacent to the edge of the top slot. Rear protrusions 25 on each of the strips extend beyond the edge of the strip and are located so that when installed they will be adjacent to the bottom edge of the rear slot.

Terminal strip 20 is installed with the front protrusions abutting the forward facing surface 36 at the top slot. The terminal strip is then rotated so that protrusions 25 snap under the downward facing surface 38 of the rear slot leaving tang 22 extending downwardly below the bottom face 14 of the block. The terminal strip is held into place by the interaction between protrusions 23 on surface 36 as well as protrusions 25 on surface 38. For this reason the terminal strips are bent at an angle substantially most equal to the angle between the top slot and the rear slot so that the stiffness of the terminal tends to retain the terminal against the top and rear surfaces. An upward force against the terminal tip 24 is resisted in movement by the stiffness of terminal 20. Prior to soldering into the circuit board the entire terminal could rotate around surface 38, but in doing so there is a rearward component of the motion of tang 23 which causes interference against surface 36.

A second row of terminals close to the circuit board 40 may be supplied with lower terminal strip 30 fitting within slot 42 with a bottom face 14 of the support block. This slot extends from the front face 16 only partially to the rear face. The terminals then may be wave soldered producing solder joints 44 securing the terminals to the circuit board 40.

Figure 6:
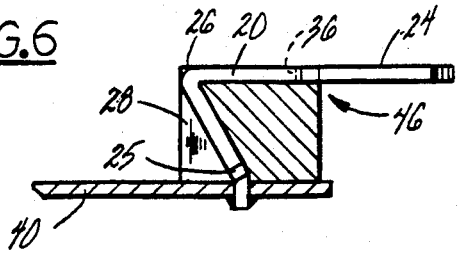
FIG. 6 is a section through an alternate arrangement of the terminal block.

FIG. 6 illustrates alternate embodiment where the rear slot 28 is at an angle less than 90° from the top slot 26. Terminal 20 is bent at a similar angle. Lower tangs 25 on the terminal strip are located a substantial distance from the rear of the block so that the tip 24 in moving upwardly can only move in arc 46 around the protrusions 25. This increases the interference against surface 36 further resisting upward movement of the terminal tips.

Figure 7:
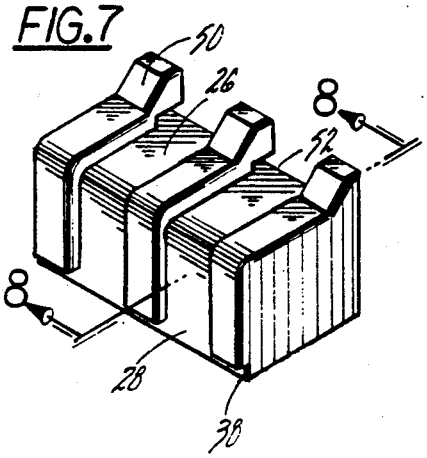
FIG. 7 is an isometric view of the terminal block having a downwardly facing surface at the front edge.

FIG. 7 illustrates an alternate embodiment with increased resistance to lifting of the terminal. A plurality of projections 50 are located on the top face near the front edge of the block. These extend over the area of protrusion so that a downwardly facing surface 52 is achieved. Installation of terminal strip 20 requires first inserting the protrusions 23 under the surface 52 and rotating the protrusions 25 so that they interlock against surface 38. Increased resistance against lifting of terminal tip 24 is thereby achieved.

Figure 8:
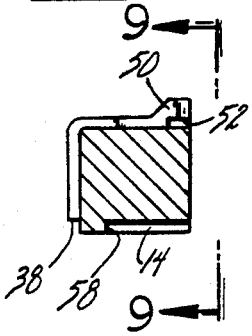
FIG. 8 is a section through the terminal block of FIG. 7.
Figure 9:
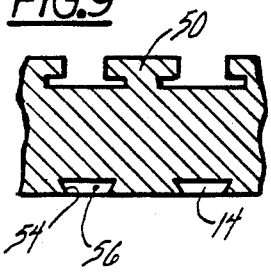
FIG. 9 is a partial front view of FIG. 8 showing the dovetail slots.

In the previous embodiment the lower terminals 30 are not securely held in the block prior to soldering the terminal. In the embodiment shown in FIGS. 7, 8 and 9 slot 14 has oblique sides 54 forming a dovetail shape 56. Terminal 30 is slid into slot 14 with the upper portion of the bent tang 34 abutting the rear surface 58 of the slot. Terminal slot 30 is thereby held in the terminal block in preparation for installation on the circuit board and soldering of the tangs.

We claim:

1. A terminal block assembly comprising:

a nonconductive elongated support block, substantially rectangular in cross section, having top, bottom and rear faces;

a plurality of conductive terminal strips, each having a width and thickness, and having a tang at one end for soldering into a circuit board and a terminal tip at the other end for mating with a connector;

a plurality of top slots across said top face and a plurality of contiguous rear slots across said rear face of said support block, of a width equal to the width of said terminal strips;

said terminal strips bent at an angle substantially at most equal to the angle between said top slot and said rear slot, and located in said slots, said tang extending below said block and said terminal tip extending beyond the front face of said block;

at least one front protrusion on each of said strips extending beyond the width of said strip and located adjacent the front edge of said top slot;

at least one rear protrusion on each of said strips extending beyond the width of said strip and located adjacent the bottom edge of said rear slot;

a downward or forward facing preexisting surface on said support block adjacent the front edge of each top slot abutting said at least one front protrusion; and a downward facing preexisting surface on said support block adjacent the bottom edge of each rear slot abutting at least on of said rear protrusion.

2. A terminal block assembly as in claim 1:

said downward or forward facing surface on said support block comprising a downward facing surface.

3. A terminal block assembly as in claim 1 having also:

a recess in said rear face at the lower edge thereof having a top downwardly facing surface, said top downwardly facing surface of said recess located above the bottom of said block a distance at least equal to the width of said at least one rear protrusion and comprising said downward facing surface adjacent the bottom edge of each rear slot.

4. A terminal block assembly as in claim 3:

the angle between said top slots and said rear slots being substantially 90°.

5. A terminal block assembly as in claim 4:

there being two front protrusions on each of said strips, one extending beyond the width of said strip on each side; and there being two rear protrusions on each of said strips, each extending beyond the width of said strip on each side.

6. A terminal block assembly as in claim 1:

a slot on the bottom face of said block extending from the front face partially toward the rear face;

a lower terminal strip free of protrusions having a terminal tip at one end for the mating with a connector and a tang at the other end for soldering into a circuit board;

said tang bent at 90° from the remainder of said terminal strip and said lower terminal strip located within said bottom slot.

7. A terminal block assembly as in claim 6:

said lower slot having a dovetail shape whereby said lower terminal strip is retained within said lower slot.

8. A terminal block assembly comprising:

a nonconductive elongated support block, substantially rectangular in cross section, having top, bottom and rear faces;

a plurality of conductive terminal strips, each having the width and thickness, and having a tang at one end for soldering into a circuit board and a terminal tip at the other end for mating with a connector;

a plurality of top slots across said top face and a plurality of contiguous rear slots across said rear face of said support block, of a width equal to the width of said terminal strips;

said terminal strips bent at an angle substantially at most equal to the angle between said top slot and said rear slot, and located in said slots, said tang extending below said block and said terminal tip extending beyond the front face of said block;

at least one front protrusion on each of said strips extending beyond the width of said strip and located adjacent the front edge of said top slot;

at least one rear protrusion one each of said strips extending beyond the width of said strip and located adjacent the bottom edge of said rear slot;

a downward or forward facing surface on said support block adjacent the front edge of each top slot abutting said at least one front protrusion; and a downward facing surface on said support block adjacent the bottom edge of said rear slot abutting at least one of said rear protrusion;

a recess in said rear face at the lower edge thereof having a top downwardly facing surface, said top downwardly facing surface of said recess located above the bottom of said block a distance at least equal to the width of said at least one rear protrusion; and the angle between said top slot and said rear slot being less than 90°, whereby the location of the rear slot at the bottom of said block is located substantially forward of said rear face.

9. A terminal block assembly as in claim 8:

there being two front protrusions on each of said strips, one extending beyond the width of said strip on each side; and there being two rear protrusions on each of said strips, each extending beyond the width of said strip on each side.

* * * * *